US011244599B2

(12) United States Patent
Song et al.

(10) Patent No.: US 11,244,599 B2
(45) Date of Patent: Feb. 8, 2022

(54) DISPLAY DEVICE HAVING A PLURALITY OF PIXELS AND DRIVING METHOD THEREOF USING MULTIPLE SCAN SIGNALS

(71) Applicant: Samsung Display Co., Ltd., Yongin-si (KR)

(72) Inventors: Jun Yong Song, Yongin-si (KR); Jeong Kyoo Kim, Yongin-si (KR); Jae Keun Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/719,871

(22) Filed: Dec. 18, 2019

(65) Prior Publication Data

US 2020/0265776 A1 Aug. 20, 2020

(30) Foreign Application Priority Data

Feb. 18, 2019 (KR) ..... 10-2019-0018782

(51) Int. Cl.
*G09G 3/32* (2016.01)

(52) U.S. Cl.
CPC ..... *G09G 3/32* (2013.01); *G09G 2300/0426* (2013.01); *G09G 2300/0842* (2013.01); *G09G 2310/0202* (2013.01)

(58) Field of Classification Search
CPC ..... G09G 3/32; G09G 2300/0426; G09G 2300/0842; G09G 2310/0202
See application file for complete search history.

(56) References Cited

U.S. PATENT DOCUMENTS 9,892,678 B2 2/2018 Song et al.
2014/0139510 A1 5/2014 Han et al.
(Continued)

FOREIGN PATENT DOCUMENTS

KR 10-2016-0070642 6/2016
KR 10-2017-0136110 12/2017
(Continued)

OTHER PUBLICATIONS

Office Action dated Dec. 16, 2020 for European Patent Application No. 20158094.1.

*Primary Examiner* — Wing H Chow
(74) *Attorney, Agent, or Firm* — H.C. Park & Associates, PLC

(57) ABSTRACT

A display device includes a plurality of pixels respectively coupled to first scan lines, second scan lines and data lines; and a scan driver to supply first scan signals to the first scan lines and second scan signals to the second scan lines, wherein the pixel includes a first transistor having a gate electrode connected to a first node, one electrode connected to a first power line, and other electrode connected to a second node; a second transistor having a gate electrode connected to a first scan line, one electrode connected to a data line, and other electrode connected to the first node, the second transistor being turned on in a first time period of a frame when the first scan signal is applied; a third transistor having a gate electrode connected to a second scan line, one electrode connected to the second node, and other electrode connected to an initialization line, the third transistor being turned on in the first time period and at least one second time period of the frame when the second scan signal is applied; a storage capacitor having one electrode connected to the first node and other electrode connected to the second node; and a light emitting diode having an anode connected to the second node and a cathode connected to a second power
(Continued)

line, wherein the number of the first and second scan signals applied to the pixel during the frame period is different from each other.

18 Claims, 11 Drawing Sheets

(56) References Cited

U.S. PATENT DOCUMENTS

| | | | | |
|---|---|---|---|---|
| 2014/0267215 | A1 | 9/2014 | Soni et al. | |
| 2015/0213758 | A1 | 7/2015 | Araki | |
| 2016/0133185 | A1* | 5/2016 | Yoon | G09G 3/3233 345/76 |
| 2016/0372037 | A1 | 12/2016 | Lim et al. | |
| 2017/0039952 | A1 | 2/2017 | Kim | |
| 2017/0193899 | A1 | 7/2017 | Yoon et al. | |
| 2017/0345376 | A1 | 11/2017 | Tani et al. | |
| 2018/0182298 | A1 | 6/2018 | Jang et al. | |

FOREIGN PATENT DOCUMENTS

| | | |
|---|---|---|
| KR | 10-2018-0066629 | 6/2018 |
| KR | 10-2018-0077352 | 7/2018 |

* cited by examiner

DISPLAY DEVICE HAVING A PLURALITY OF PIXELS AND DRIVING METHOD THEREOF USING MULTIPLE SCAN SIGNALS

CROSS-REFERENCE TO RELATED APPLICATION

This application claims priority from and the benefit of Korean Patent Application No. 10-2019-0018782, filed on Feb. 18, 2019, which is hereby incorporated by reference for all purposes as if fully set forth herein.

BACKGROUND

Field

Exemplary implementations of the invention relate generally to a display device and, more specifically, to a display device and driving method of the display device for controlling the amount of time each pixel emits light ("light emitting time").

Discussion of the Background

With the development of information technologies, the importance of a display device, which is a connection medium between users and information, has been highlighted. Therefore, a display device such as a liquid crystal display device, an organic light emitting diode display device, and a plasma display device has been increasingly used.

A display device may include a plurality of pixels and display a frame through a light emitting combination of pixels. For example, when the display device displays 60 frames sequentially for 1 second, the display device may be said to be driven at 60 Hz.

Conventional display devices require a separate light emitting control transistor to control the light emitting time of each pixel. For example, when the light emitting control transistor is turned off, power supplied to a driving transistor is cut off, so that the pixel is in a non-light emitting state.

However, when light emitting control transistors are formed in all pixels and a separate light emitting control driver for controlling the light emitting control transistors is formed, the area usable for the display screen of the display device must be reduced to accommodate the space required for the light emitting control driver and related components.

The above information disclosed in this Background section is only for understanding of the background of the inventive concepts, and, therefore, it may contain information that does not constitute prior art.

SUMMARY

Display devices constructed according to the principles and exemplary implementations of the invention and driving methods for same are capable of controlling light emission in a display device without the need for separate light emitting control transistors in each pixel and a separate light emitting control driver to supply separate emission control signals. Accordingly, the area usable for the display screen in such devices may be increased compared to designs with a separate light emission control driver and transistors.

Additional features of the inventive concepts will be set forth in the description which follows, and in part will be apparent from the description, or may be learned by practice of the inventive concepts.

According to an aspect of the invention, a display device includes a plurality of pixels respectively coupled to first scan lines, second scan lines and data lines; and a scan driver to supply first scan signals to the first scan lines and second scan signals to the second scan lines, wherein each of the pixels includes a first transistor having a gate electrode connected to a first node, one electrode connected to a first power line, and other electrode connected to a second node; a second transistor having a gate electrode connected to a first scan line, one electrode connected to a data line, and other electrode connected to the first node, the second transistor being turned on in a first time period of a frame period when the first scan signal is applied; a third transistor having a gate electrode connected to a second scan line, one electrode connected to the second node, and other electrode connected to an initialization line, the third transistor being turned on in the first time period and at least one second time period of the frame when the second scan signal is applied; a storage capacitor having one electrode connected to the first node and other electrode connected to the second node; and a light emitting diode having an anode connected to the second node and a cathode connected to a second power line, wherein the number of the first and second scan signals applied to the pixel during the frame is different from each other.

In the second time period, a difference between an initialization voltage applied to the initialization line and a second power voltage applied to the second power line may be lower than a light emitting threshold voltage of the light emitting diode.

In the first time period, a data signal corresponding to the frame may be applied to the data line.

In the first time period and the second time period, the light emitting diode may be in a non-light emitting state, and the light emitting diode may emit light at a luminance corresponding to the data signal when both the second transistor and the third transistor are in a turn-off state in the frame.

The frame may refer to a period from a time when the second transistor and the third transistor are turned on simultaneously to a next time when the second transistor and the third transistor are turned on again simultaneously.

The display device may further include a mobility sensing unit connected to the initialization line in a mobility sensing period.

The mobility sensing unit may include an amplifier; a capacitor connected between an inversion terminal and an output terminal of the amplifier; and an analog-to-digital converter connected to the output terminal of the amplifier, wherein, in the mobility sensing period, the initialization line is connected to the inversion terminal of the amplifier.

The display device may further include a boosting capacitor having one electrode connected to the anode of the light emitting diode and other electrode connected to the initialization line.

The threshold voltage sensing unit may include a reference voltage terminal; a capacitor; and an analog-to-digital converter connected to one electrode of the capacitor, wherein, in the threshold voltage sensing period, the initialization line is connected to the reference voltage terminal, then the initialization line is connected to one electrode of the capacitor.

The pixel may further include a boosting capacitor having one electrode connected to the anode of the light emitting diode and other electrode connected to the initialization line.

According to another aspect of the invention, a display device includes a plurality of pixels respectively coupled to first scan lines, second scan lines and data lines; and a scan driver to supply first scan signals to the first scan lines and second scan signals to the second scan lines, wherein each of the pixels includes a first transistor having a gate electrode connected to a first node, one electrode connected to a first power line, and other electrode connected to a second node; a second transistor having a gate electrode connected to a first scan line, one electrode connected to a second node, and other electrode connected to a data line, the second transistor being turned on in a first time period of a frame when the first scan signal is applied; a third transistor having a gate electrode connected to a second scan line, one electrode connected to an initialization line, and other electrode connected to the first node, the third transistor being turned on in the first time period and at least one second time period of the frame when the second scan signal is applied; a storage capacitor having one electrode connected to the first node and other electrode connected to the second node; and a light emitting diode having an anode connected to the second node and a cathode connected to a second power line, wherein the number of the first and second scan signals applied to the pixel during the frame period is different from each other.

In the second time period, a difference between a voltage applied to the second node and a second power voltage applied to the second power line may be lower than a light emitting threshold voltage of the light emitting diode.

In the first time period, a data signal corresponding to the frame may be applied to the data line.

In the first time period and the second time period, the light emitting diode may be in a non-light emitting state, and the light emitting diode may emit light at a luminance corresponding to the data signal when both the second transistor and the third transistor are in a turn-off state in the frame.

The frame may refer to a period from a time when the second transistor and the third transistor are turned on simultaneously to a next time when the second transistor and the third transistor are turned on again simultaneously.

The pixel may further include a boosting capacitor having one electrode connected to the anode of the light emitting diode and other electrode connected to the initialization line.

According to still another aspect of the invention, a method of driving a display device having a display device including a plurality of pixels, each of the pixel including a first transistor connected between a first power source and a light emitting diode, a second transistor having a gate electrode connected to a first scan line and connected between the first transistor and a data line, and a third transistor having a gate electrode connected to second scan line and connected between the first transistor and an initialization line, the method comprising the steps of: applying first and second scan signals to the first and second scan lines in a first time period of a frame to turn on the second transistor and the third transistor simultaneously, and applying second scan signal to the second scan line in at least one second time period of the frame to turn on the third transistor, wherein the number of the first and second scan signals applied to the pixel during the frame period is different from each other.

In the second time period, a difference between an initialization voltage applied to the initialization line and a second power voltage applied to the second power line may be lower than a light emitting threshold voltage of the light emitting diode.

In the first time period, a data signal corresponding to the frame may be applied to the data line.

In the first time period and the second time period, the light emitting diode may be in a non-light emitting state, and the light emitting diode may emit light at a luminance corresponding to the data signal when both the second transistor and the third transistor are in a turn-off state in the frame period.

The frame may refer to a period from a time when the second transistor and the third transistor are turned on simultaneously to a next time when the second transistor and the third transistor are turned on again simultaneously.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
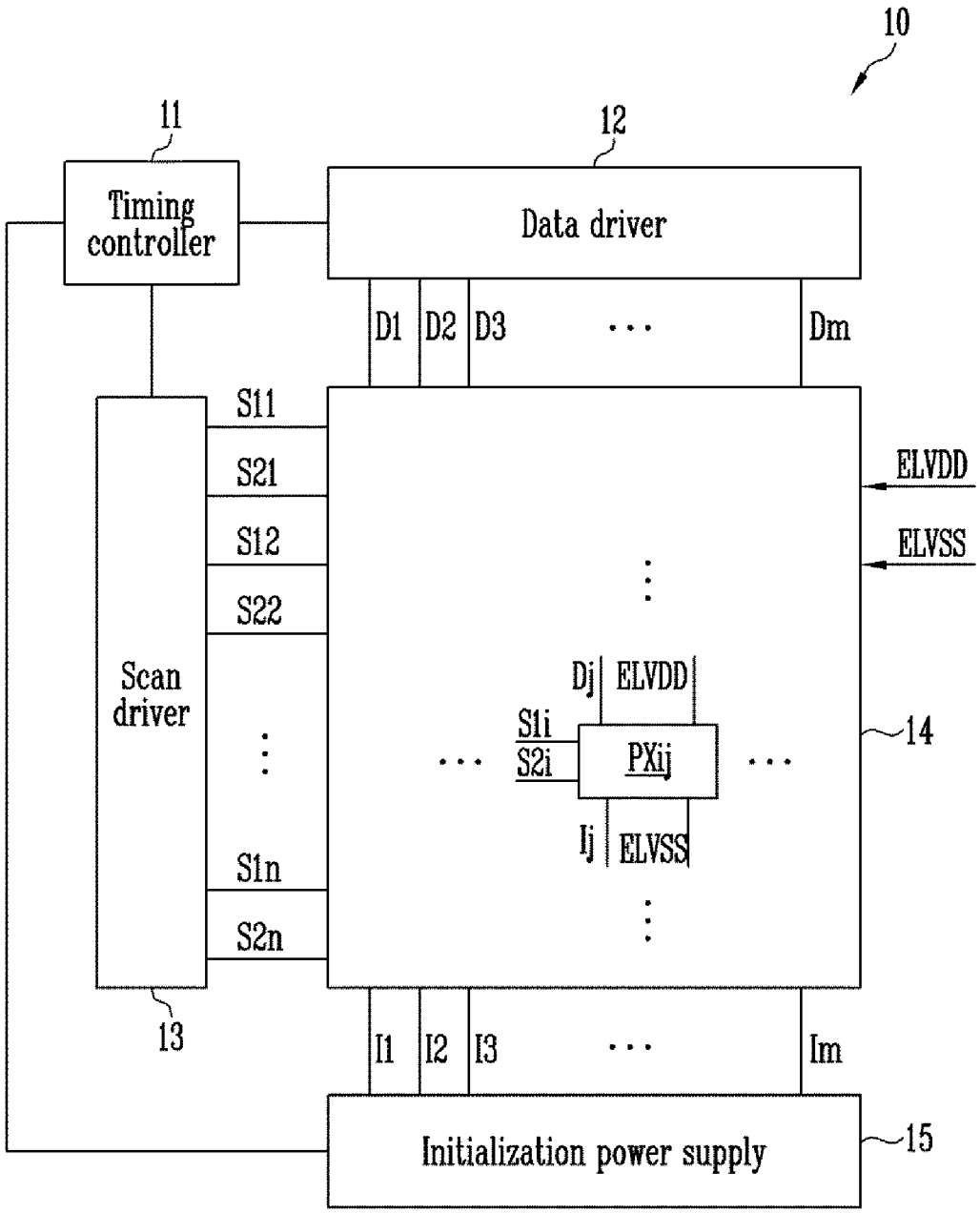
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, of a display device 10 according to an exemplary embodiment may include a timing controller 11, a data driver 12, a scan driver 13, a pixel unit 14, and an initialization power supply 15.

The timing controller 11 may receive frame information and control signals from an external processor. The timing controller 11 may convert the received frame information and control signals according to specifications of the display device 10 and supply it to the data driver 12 and the scan driver 13. For example, the timing controller 11 may supply grayscale values and control signals for each pixel of the pixel unit 14 to the data driver 12. In addition, the timing controller 11 may supply control signals such as a clock signal, a scan start signal, and the like to the scan driver 13.

The data driver 12 may generate data signals supplied to data lines D1, D2, D3, . . . , Dm using the grayscale values and control signals received from the timing controller 11. Here, m may be an integer larger than zero. For example, data signals generated in unit of pixel row may be applied to data lines D1-Dm simultaneously.

The scan driver 13 may receive control signals such as a clock signal, a scan start signal, and the like from the timing controller 11 to generate scan signals supplied to a first scan lines S11, S12, . . . , S1*n* and a second scan lines S21, S22, . . . , S2*n*. Here, n may be an integer greater than zero. For example, the scan driver 13 may select a pixel row to which the data signals are written by supplying scan signals of a turn-on level to the first scan lines S11 to S1*n* sequentially. In other words, the scan driver 13 may supply first scan signals to the first scan lines S11 to S1*n* and second scan signals to the second scan lines S21 to S2*n*. In an exemplary embodiment, the number of the first and second scan signals applied to corresponding scan lines during one frame period may be different from each other.

The pixel unit 14 includes a plurality of pixels. Each pixel PXij may be connected to the corresponding data line, first scan line, second scan line and initialization line. In addition, each pixel PXij may be connected to the first power line ELVDD and the second power line ELVSS. For example, when the data signals are applied from the data driver 12 to the data lines D1 to Dm, the data signals may be written to the pixel row that receives a first scan signal of a turn-on level from the scan driver 13.

Figure 6:
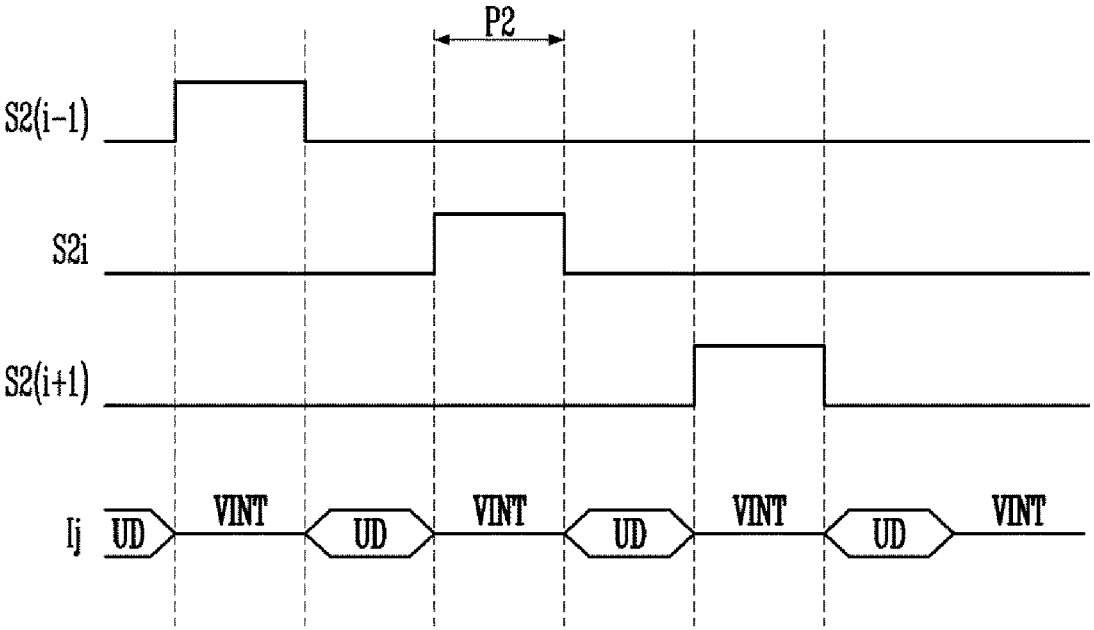
FIG. 6 is an exemplary timing diagram illustrating a driving method of the pixel shown in FIG. 5.

The initialization power supply 15 may supply an initialization voltage to initialization lines I1, I2, I3, . . . , Im. At this time, the difference between the initialization voltage and a voltage applied to the second power line ELVSS may be lower than a light emitting threshold voltage of the light emitting diode of each pixel. In an exemplary embodiment, the initialization power supply 15 may continuously supply the initialization voltages to the initialization lines I1, I2, I3, . . . , Im. In another exemplary embodiment, the initialization power supply 15 may discontinuously supply the initialization voltage to the initialization lines I1, I2, I3, . . . , Im according to the timing controller 11 or other controller. For example, the initialization power supply 15 may supply the initialization voltage in synchronization with second scan signals of the turn-on level as illustrated in FIG. 6.

Figure 10:
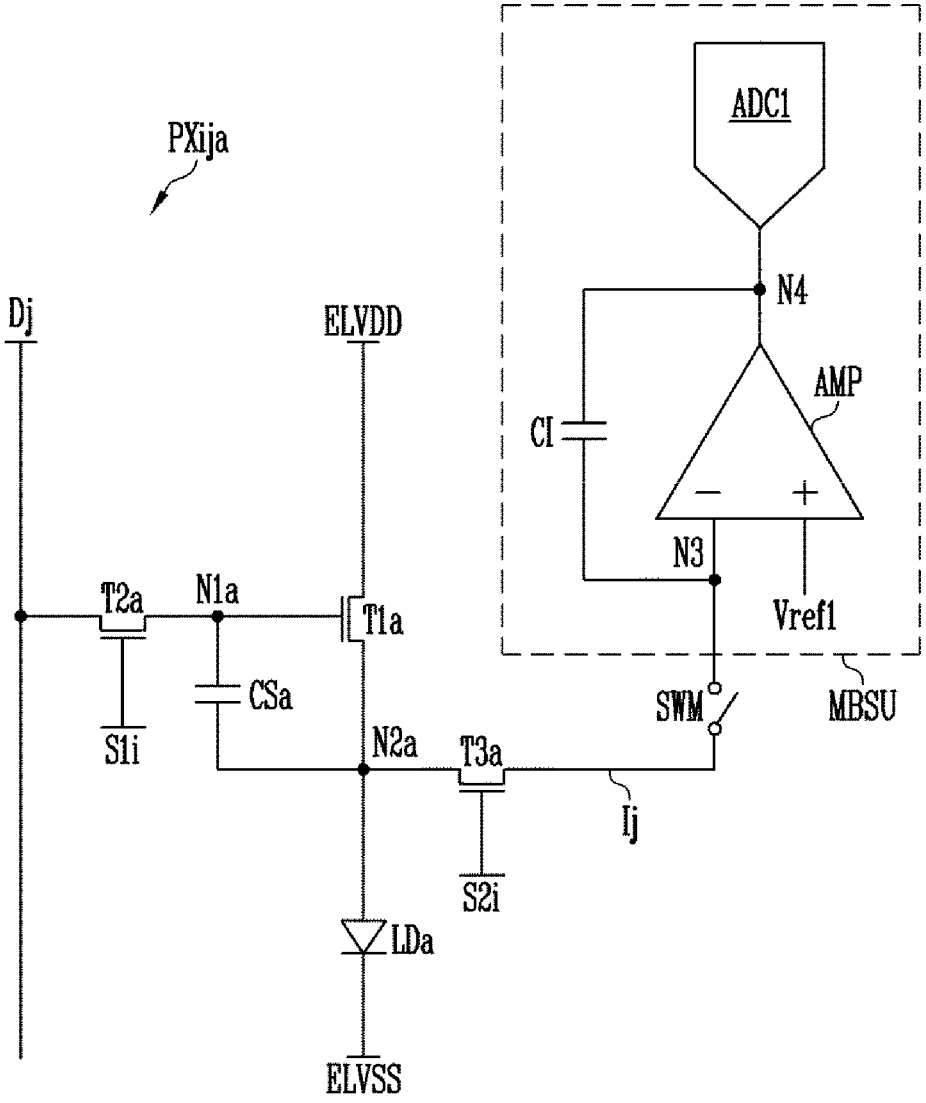
FIG. 10 is a circuit diagram of an exemplary embodiment of a mobility sensing unit constructed according to the principles of the invention.
Figure 11:
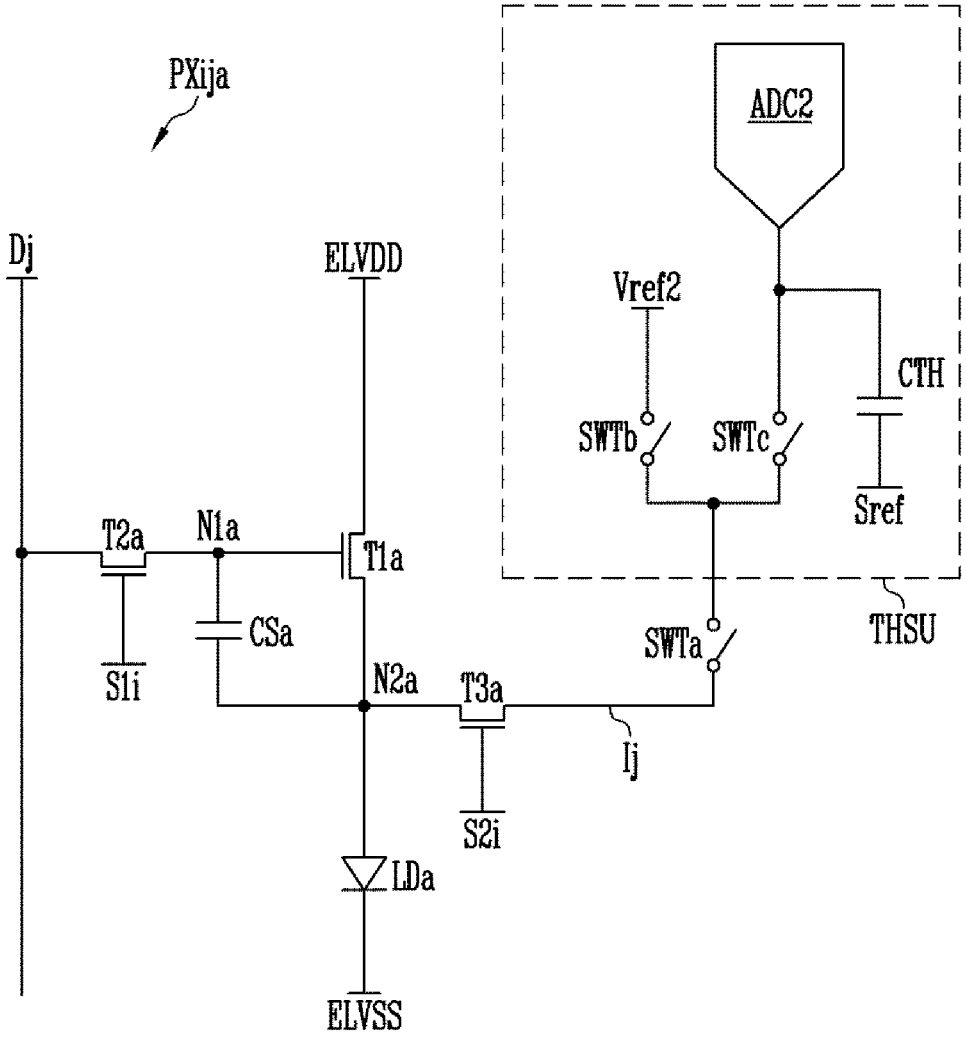
FIG. 11 is a circuit diagram of an exemplary embodiment of a threshold voltage sensing unit constructed according to the principles of the invention.

In addition, although not shown in FIG. 1, the display device 10 may further include a mobility sensing unit MBSU (see FIG. 10) and a threshold voltage sensing unit THSU (see FIG. 11). In the exemplary embodiments in which the initialization lines I1, I2, I3, . . . , Im function as sensing lines (see FIGS. 3 and 5), the mobility sensing unit MBSU and threshold voltage sensing unit THSU may be included in the initialization power supply 15. In the exemplary embodiment in which the data lines D1-Dm function as sensing lines (see FIGS. 7 and 9), the mobility sensing unit MBSU and threshold voltage sensing unit THSU may be included in the data driver 12. In another exemplary embodiment, the mobility sensing unit MBSU and the threshold voltage sensing unit THSU may be formed separately from the data driver 12 and the initialization power supply 15.

Figure 2:
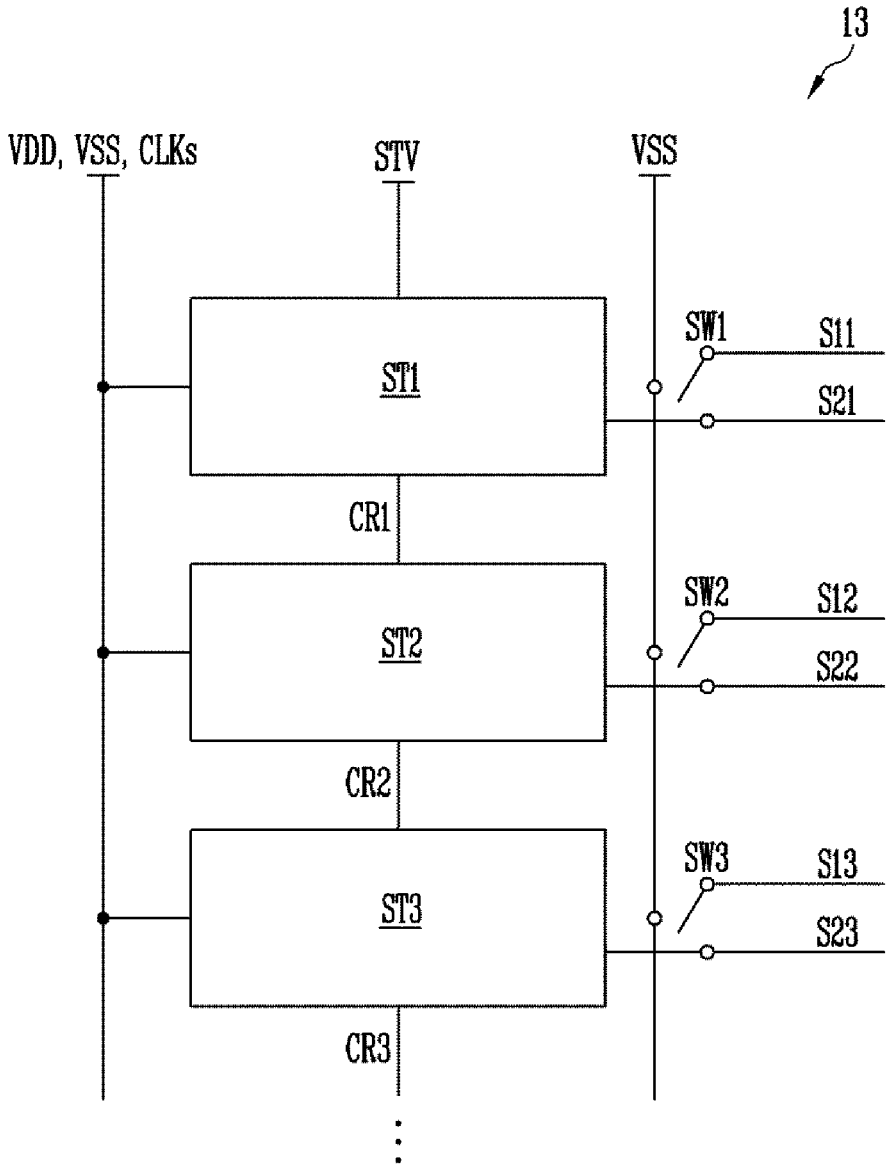
FIG. 2 is a block diagram of an exemplary embodiment of a scan driver constructed according to the principles of the invention.

FIG. 2 is a block diagram of an exemplary embodiment of a scan driver constructed according to the principles of the invention.

The scan driver 13 may include a plurality of stages ST1, ST2, ST3, and the like. Each of stages ST1, ST2, ST3, and the like may be formed with substantially the same circuit structure.

Each of stages ST1, ST2, ST3, and the like may receive clock signals CLKs, high voltage VDD and low voltage VSS. In addition, other stages ST2, ST3, and the like except the first stage ST1 may receive corresponding carry signals CR1, CR2, CR3, and the like from the previous stage. Since the first stage ST1 has no previous stage, the scan start signal STV may receive from the timing controller 11.

Each of the stages ST1, ST2, ST3, and the like may supply the first scan signal to the first scan lines S11, S12, S13, and the like, and the second scan signal to the second scan lines S21, S22, S23, and the like based on the clock signals CLKs and the carry signals CR1, CR2, CR3, and the like. Therefore, the stages ST1, ST2, ST3, and the like may sequentially supply the first scan signals or the second scan signals of a turn-on level.

The turn-on level may refer to a voltage level at which a transistor receiving the corresponding signal to a gate electrode can be turned on. For example, when the transistor is an N-type (e.g., NMOS), the turn-on level may be a logic high level. When the transistor is a P-type (e.g., PMOS), the turn-on level may be a logic low level. Hereinafter, it is assumed that transistors are formed of an N-type. Here, the turn-on level may be a logic high level.

In an exemplary embodiment, the first scan lines S11, S12, S13, and the like may be connected to the corresponding switches SW1, SW2, SW3, and the like. The switches SW1, SW2, SW3, and the like may be connected to a power line to which a low voltage VSS is applied or the corresponding second scan lines S21, S22, S23, and the like. That is, when the stages ST1, ST2, ST3, and the like supply the second scan signals of the turn-on level to the second scan lines S21, S22, S23, and the like, it may be determined whether the first scan signals of the turn-on level or the first scan signals of the low voltage VSS are supplied to the first scan lines S11, S12, S13, and the like depending on the connection state of the switches SW1, SW2, and SW3. The connection state of the switches SW1, SW2, and SW3 may be controlled by the timing controller 11 or other controller.

According to an exemplary embodiment, the scan signals may be supplied to the first scan lines S11, S12, S13, and the like and the second scan lines S21, S22, S23, and the like using a single scan driver 13, thereby enabling the display screen area of the display device 10 to be larger then conventional scan drivers.

Figure 3:
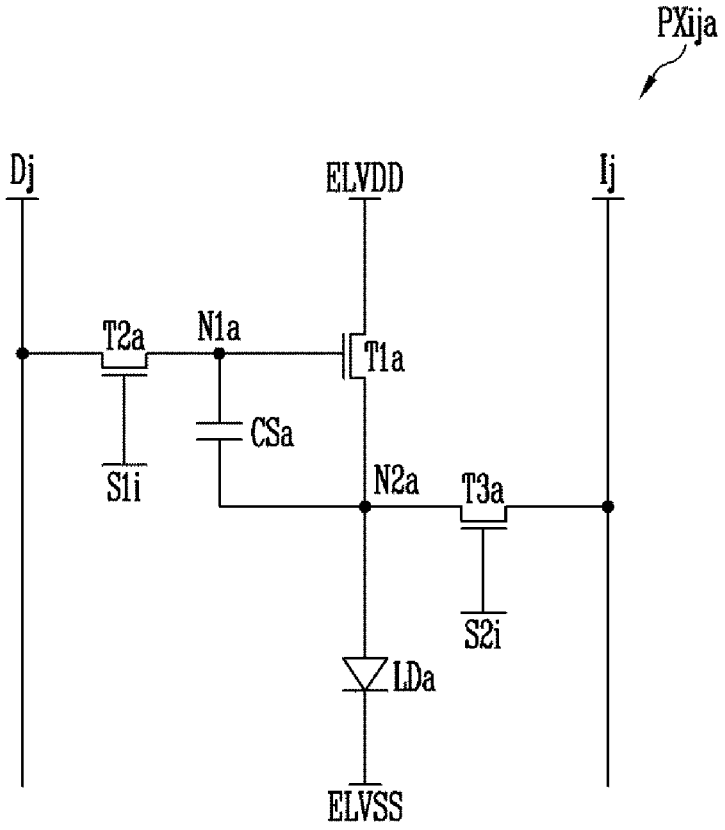
FIG. 3 is a circuit diagram of a first exemplary embodiment of a representative pixel of the display device shown in FIG. 1

FIG. 3 is a circuit diagram of a first exemplary embodiment of a representative pixel of the display device shown in FIG. 1

Referring to FIG. 3, a pixel PXija may include transistors T1*a*, T2*a*, and T3*a*, a storage capacitor CSa, and a light emitting diode LDa.

A first transistor T1*a* may have a gate electrode connected to a first node N1*a*, one electrode connected to a first power line ELVDD, and the other electrode connected to a second node N2*a*. The first transistor T1*a* may be referred to as a driving transistor.

A second transistor T2*a* may have a gate electrode connected to a first scan line S1*i*, one electrode connected to a data line Dj, and the other electrode connected to the first node N1*a*. The second transistor T2*a* may be referred to as a scan transistor, a switching transistor, or the like.

A third transistor T3*a* may have a gate electrode connected to a second scan line S2*i*, one electrode connected to a second node N2*a*, and the other electrode connected to an initialization line Ij. The third transistor T3*a* may be referred to as a sensing transistor.

The storage capacitor CSa may include one electrode connected to the first node N1*a* and the other electrode connected to the second node N2*a*.

The light emitting diode LDa may include an anode connected to the second node N2*a* and a cathode connected to the second power line ELVSS. The light emitting diode LDa may be an organic light emitting diode or an inorganic light emitting diode.

Here, i may be an integer greater than zero. In addition, j may be an integer greater than zero.

Figure 4:
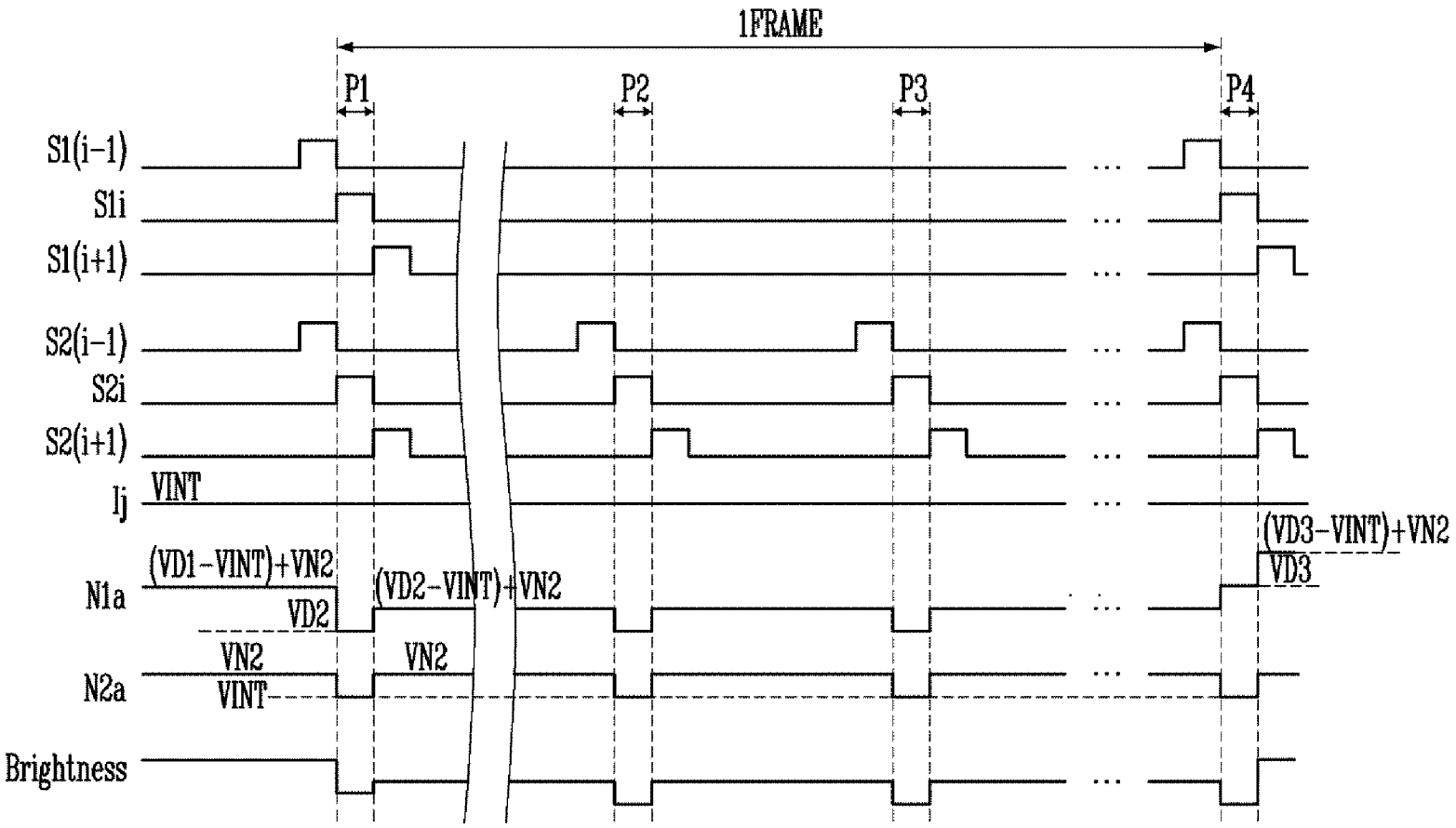
FIG. 4 is an exemplary timing diagram illustrating a driving method of the pixel shown in FIG. 3.

FIG. 4 is an exemplary timing diagram illustrating a driving method of the pixel shown in FIG. 3.

Referring to FIGS. 3 and 4, an exemplary operation of the display device 10 will be described based on one frame period 1 FRAME for a pixel PXija.

Here, one frame period 1 FRAME may refer to a period from the time when the second transistor T2*a* and the third transistor T3*a* are turned on simultaneously to the next time when the second transistor T2*a* and the third transistor T3*a* are turned on again simultaneously. One frame period 1 FRAME defined above may have different starting and finishing points for each pixel row. However, the lengths of one frame period 1 FRAME of all pixel rows may be the same.

In the previous frame period, a voltage (VD1−VINT)+VN2 is applied to the first node N1*a* of the pixel PXija and a voltage VN2 is applied to the second node N2*a*. That is, the storage capacitor CSa maintains a voltage equal to the difference between the data signal VD1 and the initialization voltage VINT of the previous frame period, and the first transistor T1*a* controls an amount of a driving current flowing between the first power line ELVDD and the second power line ELVSS corresponding to the voltage maintained by the storage capacitor CSa. Therefore, the light emitting diode LDa may emit light at a luminance corresponding to the data signal VD1.

In each frame period 1 FRAME, the first scan signal of the turn-on level may be supplied to the first scan line S1*i* p times and the second scan signal of the turn-on level may be supplied to the second scan line S2*i* q times. p may be an integer greater than 0, and q may be an integer greater than p. In an exemplary embodiment of FIG. 4, p is 1 and q is 3, but in another exemplary embodiment, p and q may be set differently. In other words, the number of the first and second scan signals of the turn-on level applied to corresponding scan lines during one frame period 1 FRAME may be different from each other. Referring to the exemplary embodiment of FIG. 4, when the first scan signal of the turn-on level is applied to the first scan line Si once during the frame period, the second scan signal of the turn-on level may be applied to the second scan line S2*i* three times during the same frame period.

In the first period P1, the first scan signal of the turn-on level may be supplied to the first scan line S1*i*, and the second scan signal of the turn-on level may be supplied to the second scan line S2*i* by the scan driver 13. Therefore, the second transistor T2*a* and the third transistor T3*a* may be turned on. In addition, the data signal VD2 corresponding to the frame period 1 FRAME may be applied to the data line Dj by the data driver 12. In addition, the initialization voltage VINT may be applied to the initialization line Ij by the initialization power supply 15. Therefore, the data signal VD2 may be applied to the first node N1*a* through the second transistor T2*a* and the initialization voltage VINT may be applied to the second node N2*a* through the third transistor T3*a*.

The difference between the initialization voltage VINT applied to the initialization line Ij and the second power voltage applied to the second power line ELVSS may be lower than the light emitting threshold voltage of the light emitting diode LDa. The light emitting diode LDa can emit light when the difference between the voltages applied to the anode and cathode exceeds the light emitting threshold voltage. Therefore, in the first period P1, the light emitting diode LDa may be in a non-light emitting state. The first period P1 may be referred to as the data writing period.

When the first period P1 ends, the first scan signal and the second scan signal of the turn-off level may be supplied to the first scan line S1*i* and the second scan line S2*i*, respectively. Therefore, the second transistor T2*a* and the third transistor T3*a* may be turned off.

Since the storage capacitor CSa maintains a voltage difference between the gate electrode and the source electrode of the first transistor T1*a*, the first transistor T1*a* may be in a turned-on state. Therefore, the driving current may flow from the first power line ELVDD to the second power line ELVSS, and the voltage VN2 may be applied to the second node N2*a*. Approximately, the voltage VN2 may be determined by Equation 1 below.

$$VN2 = (ELVDDv - ELVSSv) \times \frac{LDr}{T1r + LDr} \quad \text{[Equation 1]}$$

Here, ELVDDv is a voltage value applied to the first power line ELVDD, ELVSSv is a voltage value applied to the second power line ELVSS, T1*r* is a turn-on resistance value of the first transistor T1*a*, and LDr is a resistance value of a light emitting diode LDa. That is, the voltage VN2 may be determined by a resistance ratio between the first transistor T1*a* and the light emitting diode LDa.

Since the storage capacitor CSa maintains the voltage difference between one electrode and the other electrode, the voltage of the first node N1*a* may be changed to the voltage (VD2−VINT)+VN2.

Therefore, the light emitting diode LDa may emit light at a luminance corresponding to the data signal VD2 when both the second transistor T2*a* and the third transistor T3*a* are turned off in the frame period 1 FRAME.

In the second period P2, the first scan signal of the turn-off level may be supplied to the first scan line S1*i*, and the second scan signal of the turn-on level may be supplied to the second scan line S2*i* by the scan driver 13. Therefore, the second transistor T2*a* may be in the turn-off state and the third transistor T3*a* may be turned on. At this time, the initialization voltage VINT may be applied to the initialization line Ij by the initialization power supply 15. Therefore, the initialization voltage VINT may be applied to the second node N2*a* through the third transistor T3*a*, and the first node N1*a* may be in a floating state. Since the storage capacitor CSa maintains the voltage difference between one electrode and the other electrode, the voltage of the first node N1*a* may drop along the voltage of the second node N2*a*.

As described above, the difference between the initialization voltage VINT applied to the initialization line Ij and the second power voltage applied to the second power line ELVSS may be lower than the light emitting threshold voltage of the light emitting diode LDa. Thus, in the second period P2, the light emitting diode LDa may be in a non-light emitting state. The second period P2 may be referred to as a non-light emitting period.

When the second period P2 ends, the first scan signal and the second scan signal of the turn-off level may be supplied to the first scan line S1*i* and the second scan line S2*i*, respectively. Thus, the second transistor T2*a* and the third transistor T3*a* may be turned off.

The voltage difference between one electrode and the other electrode of the storage capacitor CSa may be maintained, the light emitting diode LDa may emit light at a luminance corresponding to the data signal VD2 when both the second transistor T2*a* and the third transistor T3*a* are in the turn-off state in the frame period 1 FRAME as described above.

Since the display device 10 in the third period P3 is driven substantially the same as the display device 10 in the second period P2, duplicate descriptions will be omitted to avoid redundancy.

The frame period 1 FRAME ends, and the next frame period may include a fourth period P4. In the fourth period P4, the data signal VD3 may be applied to the data line Dj. Since the display device 10 in the fourth period P4 is driven substantially the same as the display device 10 in the first period P1, duplicate descriptions will be omitted to avoid redundancy.

According to the illustrated exemplary embodiment, the scan driver 13 may control the number of non-light emitting periods P2 and P3 for one frame period 1 FRAME by controlling the number of first and second scan signals that are different from each other, thereby controlling the light emitting time of the pixel PXija. In other words, the number of the first and second scan signals of the turn-on level applied to the same pixel PXija during one frame period 1 FRAME may be different each other. For example, when the first scan signal of the turn-on level is applied to the first scan line Si once (i.e., the first period P1) during the frame period 1 FRAME, the second scan signal of the turn-on level may be applied to the second scan line S2*i* three times (i.e., the first, second, and third period P1, P2, and P3) during the same the frame period 1 FRAME, thereby there are two non-light emitting periods (i.e., P2 and P3) for the frame period 1 FRAME. Therefore, the light emitting time of the pixel PXija may be controlled without a light emitting control transistor and a light emitting control driver. In particular, it is difficult to express the low grayscale only by control of the data signal. However, an exemplary embodiment may easily express the low grayscale by controlling the light emitting time of the pixel PXija together with the magnitude of the data signal.

Figure 5:
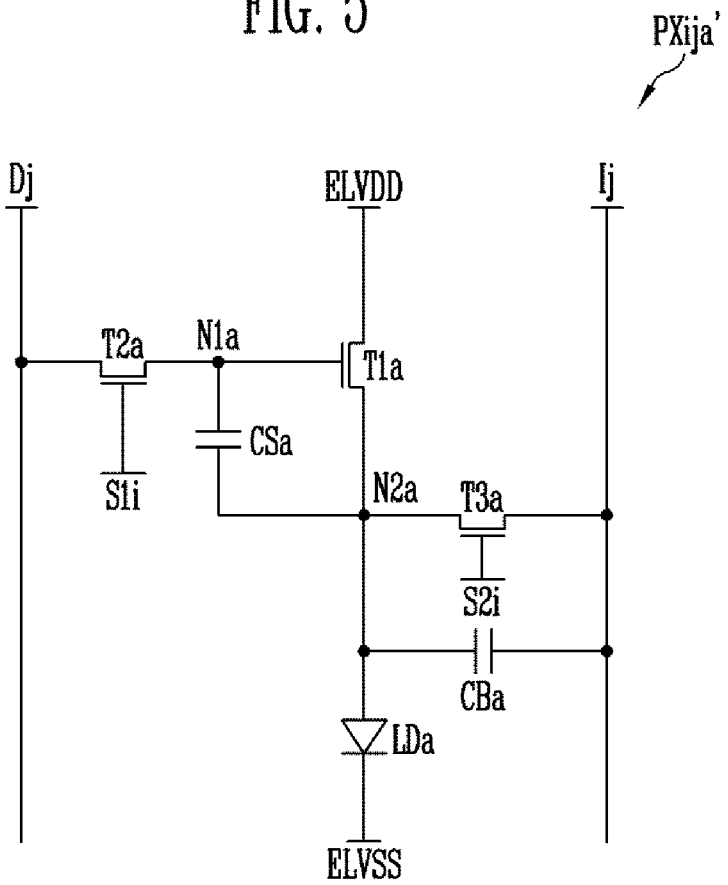
FIG. 5 is a circuit diagram of a second exemplary embodiment of a representative pixel of the display device shown in FIG. 1.

FIG. 5 is a circuit diagram of a second exemplary embodiment of a representative pixel of the display device shown in FIG. 1

A pixel PXija' of FIG. 5 further includes a boosting capacitor CBa compared to the pixel PXija of FIG. 3.

The boosting capacitor CBa may include one electrode connected to the anode of the light emitting diode LDa and the other electrode connected to the initialization line Ij.

FIG. 6 is an exemplary timing diagram illustrating a driving method of the pixel shown in FIG. 5.

In the driving method of FIG. 6, duplicate descriptions with FIG. 4 will be omitted to avoid redundancy. A timing diagram of FIG. 4 is shown enlarged around the second period P2 in FIG. 6.

The initialization power supply 15 may discontinuously supply an initialization voltage VINT to the initialization line Ij. For example, the initialization power supply 15 may supply the initialization voltage VINT to the initialization line Ij in synchronization with the second scan signals of the turn-on level applied to the second scan lines S2(*i*−1), S2*i*, and S2(*i*+1). The initialization power supply 15 may float the initialization line Ij to an undefined state when the initialization voltage VINT is not supplied.

According to an exemplary embodiment, the voltage of the initialization line Ij is changed from the undefined state to the initialization voltage VINT in synchronization with the turn-on of the third transistor T3*a*, so that a voltage of the node N2*a* may be discharged more quickly by the boosting capacitor. Therefore, the light emitting diode LDa quickly enters an non-light emitting state in the first to third periods P1, P2, and P3 of the frame period 1 FRAME, so that the light emitting time of the light emitting diode LDa may be controlled more precisely.

If the initialization voltage VINT is continuously supplied to the pixel PXija', the voltage difference between the second node N2*a* and the initialization line Ij may be maintained by the boosting capacitor CBa despite the turn-on of the third transistor T3*a*. Therefore, the light emitting diode LDa may take longer to enter the non-light emitting state.

In another exemplary embodiment, the initialization power supply 15 may supply a voltage greater than the initialization voltage VINT to the initialization line Ij when the initialization voltage VINT is not supplied. In this case, the voltage of the second node N2*a* may be discharged more quickly since a drop pulse occurs in the initialization line Ij in synchronism with the turn-on of the third transistor T3*a*.

Figure 7:
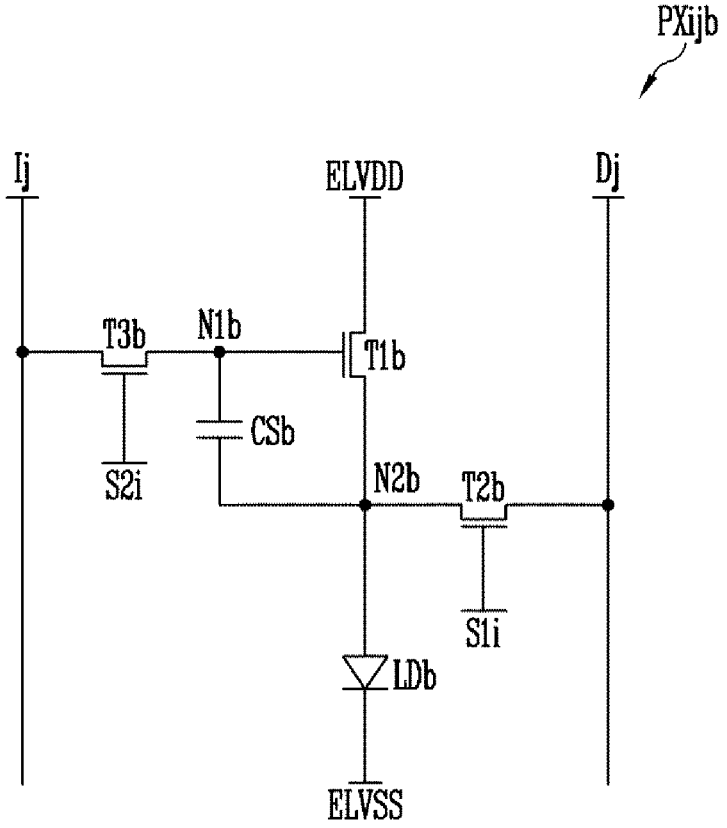
FIG. 7 is a circuit diagram of a third exemplary embodiment of a representative pixel of the display device shown in FIG. 1

FIG. 7 is a circuit diagram of a third exemplary embodiment of a representative pixel of the display device shown in FIG. 1

Referring to FIG. 7, the pixel PXijb may include transistors T1*b*, T2*b*, and T3*b*, a storage capacitor CSb, and a light emitting diode LDb.

A first transistor T1*b* may have a gate electrode connected to a first node N1*b*, one electrode connected to a first power line ELVDD, and the other electrode connected to a second node N2*b*. The first transistor T1*b* may be referred to as a driving transistor.

A second transistor T2*b* may have a gate electrode connected to a first scan line S1*i*, one electrode connected to the second node N2*b*, and the other electrode connected to a data line Dj. The second transistor T2*b* may be referred to as a scan transistor, a switching transistor, or the like.

A third transistor T3*b* may have a gate electrode connected to a second scan line S2*i*, one electrode connected to an initialization line Ij, and the other electrode connected to the first node N1*b*. The third transistor T3*b* may be referred to as a sensing transistor.

The storage capacitor CSb may include one electrode connected to the first node N1*b* and another electrode connected to the second node N2*b*.

The light emitting diode LDb may include an anode connected to the second node N2*b* and a cathode connected to the second power line ELVSS. The light emitting diode LDb may be an organic light emitting diode or an inorganic light emitting diode.

Figure 8:
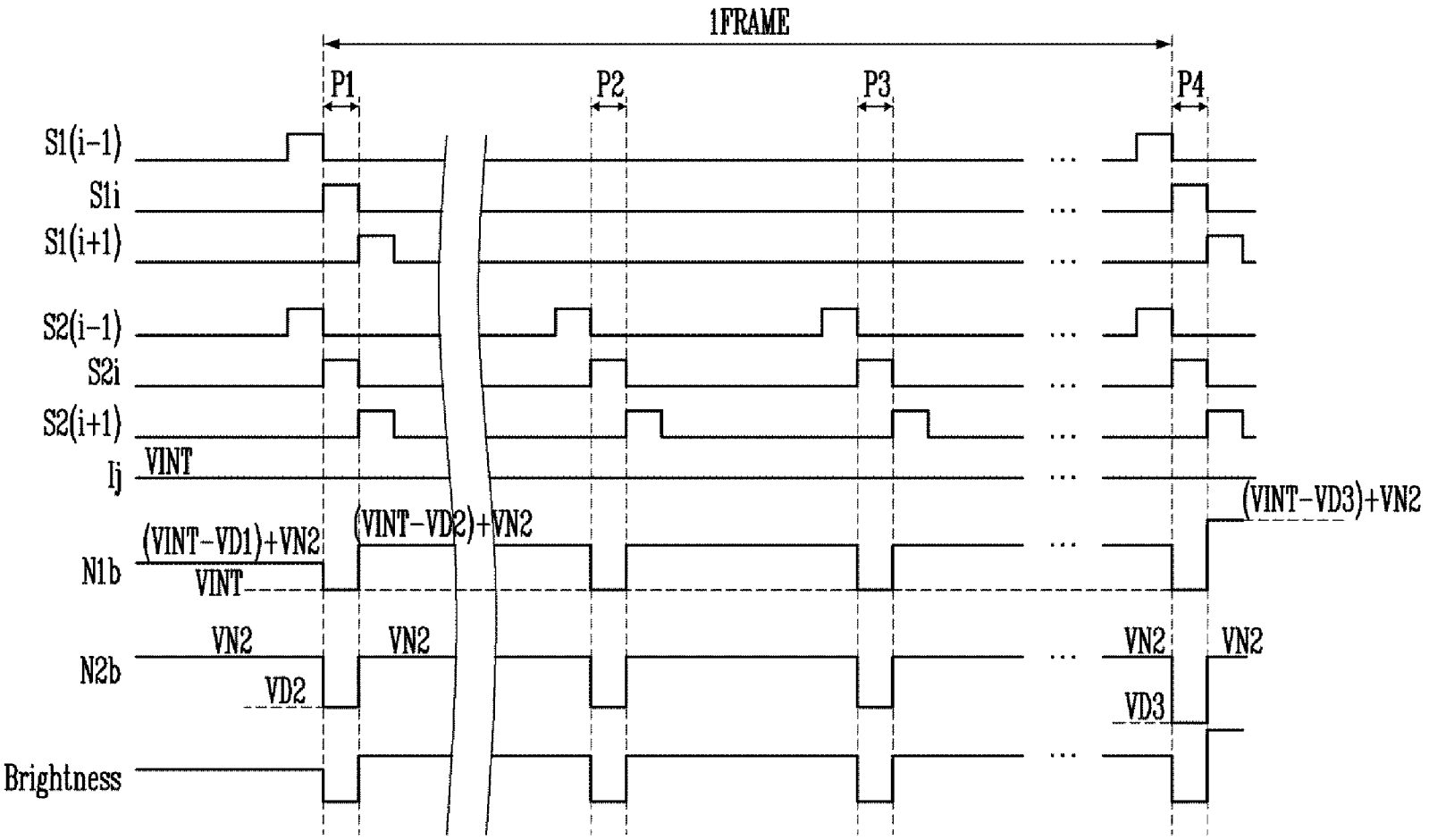
FIG. 8 is an exemplary timing diagram illustrating a driving method of the pixel shown in FIG. 7.

FIG. 8 is an exemplary timing diagram illustrating a driving method of the pixel shown in FIG. 7.

Referring to FIGS. 7 and 8, an operation of the display device 10 will be described based on one frame period 1 FRAME for a pixel PXija.

In the previous frame period, a voltage (VINT−VD1)+VN2 is applied to the first node N1*b* of the pixel PXijb and a voltage VN2 is applied to the second node N2*b*. The storage capacitor CSb maintains a voltage equal to the difference between the initialization voltage VINT and the data signal VD1 of the previous frame period, the first transistor T1*b* controls an amount of a driving current flowing between the first power line ELVDD and the second power line ELVSS corresponding to the voltage maintained by the storage capacitor CSb. Therefore, the light emitting diode LDb may emit light at a luminance corresponding to the data signal VD1.

In the first period P1, the first scan signal of the turn-on level may be supplied to the first scan line S1*i* and the second scan signal of the turn-on level may be supplied to the second scan line S2*i* by the scan driver 13. Thus, the second transistor T2*b* and the third transistor T3*b* may be turned on. In addition, the data signal VD2 corresponding to the frame period 1 FRAME may be applied to the data line Dj by the data driver 12. In addition, the initialization voltage VINT may be applied to the initialization line Ij by the initialization power supply 15. Therefore, the data signal VD2 may be applied to the second node N2*b* through the second transistor T2*b* and the initialization voltage VINT may be applied to the first node N1*b* through the third transistor T3*b*.

The difference between a voltage (e.g., data signal VD2) applied to the second node VN2 and the second power voltage applied to the second power line ELVSS may be lower than the light emitting threshold voltage of the light emitting diode LDb. Thus, in the first period P1, the light emitting diode LDb may be in a non-light emitting state. The first period P1 may be referred to as a data writing period.

When the first period P1 ends, the first scan signal and the second scan signal of the turn-off level may be supplied to the first scan line S1*i* and the second scan line S2*i*, respectively. Thus, the second transistor T2*b* and the third transistor T3*b* may be turned off.

Since the storage capacitor CSb maintains the voltage difference between the gate electrode and the source electrode of the first transistor T1*b*, the first transistor T1*b* may be turned on. Therefore, driving current flows from the first power line ELVDD to the second power line ELVSS, and a voltage VN2 may be applied to the second node N2*b*. Equation 1 described above is referred for the voltage VN2.

Since the storage capacitor CSb maintains the voltage difference between one electrode and the other electrode, a voltage of the first node N1*b* may be changed to a voltage (VINT−VD2)+VN2.

Therefore, the light emitting diode LDb may emit light at a luminance corresponding to the data signal VD2 when both the second transistor T2*b* and the third transistor T3*b* are turned off in the frame period 1 FRAME.

In the second period P2, the first scan signal of the turn-off level may be supplied to the first scan line S1*i*, and the second scan signal of the turn-on level may be supplied to the second scan line S2*i* by the scan driver 13. Thus, the second transistor T2*b* may be in the turn-off state and the third transistor T3*b* may be turned on. At this time, the initialization voltage VINT may be applied to the initialization line Ij by the initialization power supply 15. Therefore, the initialization voltage VINT may be applied to the first node N1*b* through the third transistor T3*b*. Since the storage capacitor CSb maintains the voltage difference between one electrode and the other electrode, a voltage of the second node N2*b* may drop along a voltage of the first node N1*b*. Thus, in the second period P2, the light emitting diode LDb may be in a non-light emitting state. The second period P2 may be referred to as a non-light emitting period.

When the second period P2 ends, the first scan signal and the second scan signal of the turn-off level may be supplied to the first scan line S1*i* and the second scan line S2*i*, respectively. Thus, the second transistor T2*b* and the third transistor T3*b* may be turned off.

The voltage difference between one electrode and the other electrode of the storage capacitor CSb may be maintained, the light emitting diode LDb may emit light at a luminance corresponding to the data signal VD2 when both the second transistor T2*b* and the third transistor T3*b* are in the turn-off state in the frame period 1 FRAME as described above.

Since the display device 10 in the third period P3 is driven substantially the same as the display device 10 in the second period P2, duplicate descriptions will be omitted to avoid redundancy.

The frame period 1 FRAME ends, and the next frame period may include the fourth period P4. In the fourth period P4, the data signal VD3 may be applied to the data line Dj. Since the display device 10 in the fourth period P4 is driven substantially the same as the display device 10 in the first period P1, duplicate descriptions will be omitted to avoid redundancy.

According to the illustrated exemplary embodiment, the scan driver 13 may control the number of non-light emitting periods P2 and P3 for one frame period 1 FRAME by controlling the number of first and second scan signals that are different from each other, thereby controlling a light emitting time of the pixel PXijb. In other words, the number of the first and second scan signals of the turn-on level applied to the same pixel PXija during one frame period 1 FRAME may be different each other. For example, when the first scan signal of the turn-on level is applied to the first scan line Si once (i.e., the first period P1) during the frame period 1 FRAME, the second scan signal of the turn-on level may be applied to the second scan line S2*i* three times (i.e., the first, second, and third period P1, P2, and P3) during the same the frame period 1 FRAME, thereby there are two non-light emitting periods (i.e., P2 and P3) for the frame period 1 FRAME. Therefore, the light emitting time of the pixel PXijb may be controlled without a light emitting control transistor and a light emitting control driver. In particular, it is difficult to express the low grayscale only by control of the data signal. However, an exemplary embodiment may easily express the low grayscale by controlling the light emitting time of the pixel PXijb together with a magnitude of the data signal.

Figure 9:
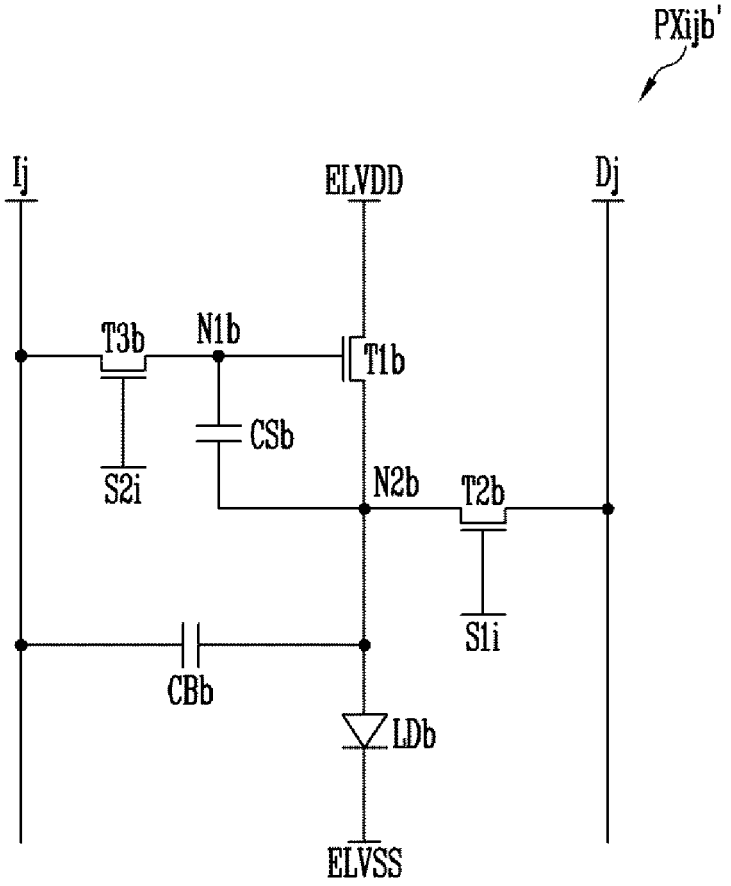
FIG. 9 is a circuit diagram of a fourth exemplary embodiment of a representative pixel of the display device shown in FIG. 1.

FIG. 9 is a circuit diagram of a fourth exemplary embodiment of a representative pixel of the display device shown in FIG. 1.

A pixel PXijb' of FIG. 9 further includes a boosting capacitor CBb compared to the pixel PXijb of FIG. 7.

The boosting capacitor CBb may include one electrode connected to the anode of the light emitting diode LDb and the other electrode connected to the initialization line Ij.

Since the driving method of FIG. 6 is equally applied to the pixel PXijb' of FIG. 9, duplicate descriptions will be omitted to avoid redundancy.

FIG. 10 is a circuit diagram of an exemplary embodiment of a mobility sensing unit constructed according to the principles of the invention.

Referring to FIG. 10, a case where a mobility sensing unit MBSU is connected to the pixel PXija of FIG. 3 will be described. Since a case where the mobility sensing unit MBSU is connected to the pixel PXija' of FIG. 5 is substantially the same as the case where the mobility sensing unit MBSU is connected to the pixel PXija of FIG. 3, duplicate descriptions will be omitted to avoid redundancy.

The mobility sensing unit MBSU may include an amplifier AMP, a capacitor CI, and an analog-to-digital converter ADC1.

In an exemplary embodiment, an inversion terminal of the amplifier AMP is defined as a third node N3, and an output terminal of the amplifier AMP is defined as a fourth node N4. A first reference voltage Vref1 may be applied to a non-inversion terminal of the amplifier AMP.

The capacitor CI may be connected between the inversion terminal (i.e., third node N3) and the output terminal (i.e., fourth node N4) of the amplifier AMP.

The analog-to-digital converter ADC1 may be connected to the output terminal (i.e., fourth node N4) of the amplifier AMP.

In a mobility sensing period, the initialization line Ij may be connected to the mobility sensing unit MBSU. For example, the initialization line Ij may be connected to the mobility sensing unit MBSU through a switch SWM.

Since the mobility sensing period consists of a frame period 1 FRAME and a separate period, the mobility sensing period may not affect an image display. In another exemplary embodiment, since the mobility sensing period consists of a part of the frame period 1 FRAME and is performed only a part of pixels, the mobility sensing period may affect relatively small an image display.

In the mobility sensing period, the first scan signal and the second scan signal of the turn-on level may be applied to the first scan line S1*i* and the second scan line S2*i*, respectively, and thus the second and third transistors T2*a* and T3*a* may be turned on. At this time, a specific voltage may be applied to the data line Dj, and the first node N1*a* may be charged to a specific voltage.

A voltage of the inversion terminal and the non-inversion terminal of the amplifier AMP may have the same characteristics (e.g., OP-AMP). Therefore, the voltage of the third node N3 may be the first reference voltage Vref1.

For example, current flowing in the first transistor T1*a* in a saturated state may be determined by Equation 2 below.

$$Id = \frac{1}{2}(u \times Co)\left(\frac{W}{L}\right)(Vgs - Vth)^2 \quad \text{[Equation 2]}$$

Here, Id is a current flowing in the first transistor T1*a*, u is a mobility, Co is a capacitance formed by a channel, an insulation layer and the gate electrode of the first transistor T1*a*, W is a width of the channel of the first transistor T1*a*, L is a length of the channel of the first transistor T1*a*, Vgs is a voltage difference between the gate electrode and the source electrode of the first transistor T1*a*, and Vth is the threshold voltage value of the first transistor T1*a*.

Here, Co, W, and L are fixed constants. Vth may be detected by other detection methods (e.g., see FIGS. 11 and 12). Vgs is the difference between the specific voltage and the first reference voltage Vref1. Id may be calculated using a voltage of the fourth node N4 measured by the analog-to-digital converter ADC1 (the amplifier AMP and the capacitor CI are disposed in a form of integrators). Therefore, the mobility u, which is the remaining variable, may be obtained.

The mobility sensing unit MBSU 7 may be also connected to the pixels PXijb of FIG. 7. or the pixels PXijb' of FIG. 9. However, the mobility sensing unit MBSU is different from the exemplary embodiment of FIG. 10 in that it is connected to the data line Dj of the pixels PXijb and PXijb'. Since the mobility sensing method of this case is substantially similar to the mobility sensing method of FIG. 10, duplicate descriptions will be omitted to avoid redundancy.

Figure 12:
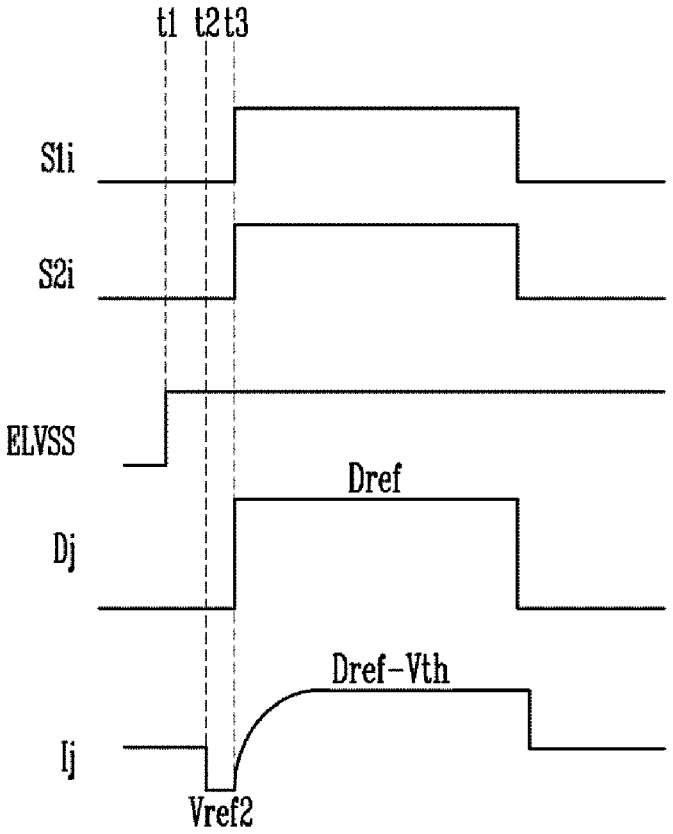
FIG. 12 is an exemplary timing diagram illustrating a threshold voltage sensing period of FIG. 11.

FIG. 11 is a circuit diagram of an exemplary embodiment of a threshold voltage sensing unit constructed according to the principles of the invention, and FIG. 12 is an exemplary timing diagram illustrating a threshold voltage sensing period of FIG. 11.

Referring to FIGS. 11 and 12, a case where a threshold voltage sensing unit THSU 3 is connected to the pixel PXija of FIG. 3 will be described. Since the case where the threshold voltage sensing unit THSU is connected to the pixel PXija' of FIG. 5 is substantially the same as the case where the threshold voltage sensing unit THSU is connected to the pixel PXija of FIG. 3, duplicate descriptions will be omitted to avoid redundancy.

The threshold voltage sensing unit THSU may include a reference voltage terminal, a capacitor CTH and an analog-to-digital converter ADC2.

A second reference voltage Vref2 may be applied to the reference voltage terminal. For example, the reference voltage terminal may be connected to the initialization line Ij when switches SWTa and SWTb are turned on.

One electrode of the capacitor CTH may be connected to the analog-digital converter ADC2, and a support reference voltage Sref may be applied to the other electrode of the capacitor CTH. For example, the support reference voltage Sref may be a ground voltage. For example, one electrode of the capacitor CTH may be connected to an initialization line Ij when the switches SWTa and SWTc are turned on.

In the threshold voltage sensing period, the initialization line Ij may be connected to the threshold voltage sensing unit THSU. For example, in the threshold voltage sensing period, the initialization line Ij may be connected to the threshold voltage sensing unit THSU through the switch SWTa.

Since the threshold voltage sensing period consists of a frame period 1 FRAME and a separate period, the threshold voltage sensing period may not affect an image display. In another exemplary embodiment, since the threshold voltage sensing period consists of a part of the frame period 1 FRAME and is performed only by some of the pixels, the threshold voltage sensing period may only affect the image display in a relatively small manner.

In the threshold voltage sensing period, the initialization line Ij may be first connected to the reference voltage terminal, and then the initialization line Ij may be connected to one electrode of the capacitor CTH. Hereinafter, the embodiments will be described in more detail with reference to FIG. 12.

First, at a first time point t1, a voltage of the second power line ELVSS rises, so that the light emitting of the light emitting diode LDa may be prevented in advance.

Next, at a second time point t2, the reference voltage terminal is connected to the initialization line Ij, so that the initialization line Ij may be discharged to the second reference voltage Vref2.

At the third time t3, the first scan signal and the second scan signal of the turn-on level may be applied to the first scan line S1*i* and the second scan line S2*i*. At this time, a data reference voltage Dref may be applied to the data line Dj. In addition, the initialization line Ij may be connected to one electrode of the capacitor CTH.

The second node N2*a* may rise from the second reference voltage Vref2 to a voltage Dref-Vth. When the second node N2*a* rises to the voltage Dref-Vth, the first transistor T1*a* is turned off, so that a voltage of the second node N2*a* does not rise any more.

At this time, the analog-digital converter ADC2 may receive the voltage of one electrode of the capacitor CTH in which the voltage of the second node N2*a* is recorded, so that the threshold voltage value Vth of the first transistor T1*a* may be calculated.

The threshold voltage sensing unit THSU may be also connected to the pixels PXijb of FIG. 7 or the pixels PXijb' of FIG. 9. However, the threshold voltage sensing unit THSU is different from the exemplary embodiment of FIG. 11 in that it is connected to the data line Dj of the pixels PXijb and PXijb'. Since the threshold voltage sensing method of this case is substantially similar to the threshold voltage sensing method of FIG. 12, duplicate descriptions will be omitted to avoid redundancy.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a plurality of pixels respectively coupled to first scan lines, second scan lines and data lines; and a scan driver to supply first scan signals to the first scan lines and second scan signals to the second scan lines, wherein each of the pixels includes:

a first transistor having a gate electrode connected to a first node, one electrode connected to a first power line, and other electrode connected to a second node;

a second transistor having a gate electrode connected to a first scan line, one electrode connected to a data line, and other electrode connected to the first node, the second transistor being turned on in a first time period of a frame when the first scan signal is applied;

a third transistor having a gate electrode connected to a second scan line, one electrode connected to the second node, and other electrode connected to an initialization line, the third transistor being turned on in the first time period and at least two second time periods of the frame when the second scan signals are applied;

a storage capacitor having one electrode connected to the first node and other electrode connected to the second node;

a light emitting diode having an anode connected to the second node and a cathode connected to a second power line; and a boosting capacitor, different from the storage capacitor, having one electrode to the anode of the light emitting diode and another electrode connected to the initialization line, wherein the number of the first and second scan signals applied to the pixel during the frame is different from each other.

2. The display device of claim 1, wherein, in each of the second time periods, a difference between an initialization voltage applied to the initialization line and a second power voltage applied to the second power line is lower than a light emitting threshold voltage of the light emitting diode.

3. The display device of claim 2, wherein, in the first time period, a data signal corresponding to the frame is applied to the data line.

4. The display device of claim 3, wherein, in the first time period and the second time periods, the light emitting diode is in a non-light emitting state, and the light emitting diode emits light at a luminance corresponding to the data signal when both the second transistor and the third transistor are in a turn-off state in the frame.

5. The display device of claim 4, wherein the frame is defined by a period of time from the time when the second transistor and the third transistor are turned on simultaneously to the next time when the second transistor and the third transistor are turned on again simultaneously.

6. The display device of claim 1, further comprising a mobility sensing unit connected to the initialization line in a mobility sensing period.

7. The display device of claim 6, wherein the mobility sensing unit comprises an amplifier;

a capacitor connected between an inversion terminal and an output terminal of the amplifier; and an analog-to-digital converter connected to the output terminal of the amplifier, wherein, in the mobility sensing period, the initialization line is connected to the inversion terminal of the amplifier.

8. The display device of claim 1, further comprising a threshold voltage sensing unit connected to the initialization line in a threshold voltage sensing period.

9. The display device of claim 8, wherein the threshold voltage sensing unit comprises a reference voltage terminal;

a capacitor; and an analog-to-digital converter connected to one electrode of the capacitor, wherein, in the threshold voltage sensing period, the initialization line is connected to the reference voltage terminal, then the initialization line is connected to one electrode of the capacitor.

10. A display device comprising:

a plurality of pixels respectively coupled to first scan lines, second scan lines and data lines; and a scan driver to supply first scan signals to the first scan lines and second scan signals to the second scan lines, wherein each of the pixels includes a first transistor having a gate electrode connected to a first node, one electrode connected to a first power line, and other electrode connected to a second node;

a second transistor having a gate electrode connected to a first scan line, one electrode connected to the second node, and other electrode connected to a data line, the second transistor being turned on in a first time period of a frame when the first scan signal is applied;

a third transistor having a gate electrode connected to a second scan line, one electrode connected to an initialization line, and other electrode connected to the first node, the third transistor being turned on in the first time period and at least one second time period of the frame when the second scan signal is applied;

a storage capacitor having one electrode connected to the first node and other electrode connected to the second node;

a light emitting diode having an anode connected to the second node and a cathode connected to a second power line; and a boosting capacitor, different from the storage capacitor, having one electrode connected to the anode of the light emitting diode and another electrode connected to the initialization line, wherein the number of the first and second scan signals applied to the pixel during the frame is different from each other.

11. The display device of claim 10, wherein, in the second time period, a difference between a voltage applied to the second node and a second power voltage applied to the second power line is lower than a light emitting threshold voltage of the light emitting diode.

12. The display device of claim 11, wherein, in the first time period, a data signal corresponding to the frame is applied to the data line.

13. The display device of claim 12, wherein, in the first time period and the second time period, the light emitting diode is in a non-light emitting state, and the light emitting diode emits light at a luminance corresponding to the data signal when both the second transistor and the third transistor are in a turn-off state in the frame.

14. The display device of claim 13, wherein the frame refers to a period of time from a time when the second transistor and the third transistor are turned on simultaneously to the next time when the second transistor and the third transistor are turned on again simultaneously.

15. A method of driving a display device having a plurality of pixels, each of the pixels including a first transistor connected between a first power source and a light emitting diode, a second transistor having a gate electrode connected to a first scan line and connected between the first transistor and a data line, a third transistor having a gate electrode connected to second scan line and connected between the first transistor and an initialization line, and a boosting capacitor, different from the storage capacitor, having one electrode connected to the anode of the light emitting diode and another electrode connected to the initialization line, the method comprising the steps of:

applying first and second scan signals to the first and second scan lines in a first time period of a frame to turn on the second transistor and the third transistor simultaneously, and applying second scan signals to the second scan line in at least two second time periods of the frame to turn on the third transistor, wherein the number of the first and second scan signals applied to the pixel during the frame is different from each other.

16. The driving method of a display device of claim 15, wherein, in each of the second time periods, the difference between an initialization voltage applied to the initialization line and a second power voltage applied to the second power line is lower than a light emitting threshold voltage of the light emitting diode.

17. The driving method of a display device of claim 16, wherein, in the first time period, a data signal corresponding to the frame is applied to the data line.

18. The driving method of a display device of claim 17, wherein, in the first time period and the second time periods, the light emitting diode is in a non-light emitting state, the light emitting diode emits light at a luminance corresponding to the data signal when both the second transistor and the third transistor are in a turn-off state in the frame, and the frame refers to a period of time from the time when the second transistor and the third transistor are turned on simultaneously to the next time when the second transistor and the third transistor are turned on again simultaneously.

* * * * *